US011280599B2

(12) United States Patent
Billings

(10) Patent No.: US 11,280,599 B2
(45) Date of Patent: Mar. 22, 2022

(54) RIFLED BARREL HAVING A RIFLED AND NON-RIFLED PORTION

(71) Applicant: Chris Lee Billings, Layton, UT (US)

(72) Inventor: Chris Lee Billings, Layton, UT (US)

( * ) Notice: Subject to any disclaimer, the term of this patent is extended or adjusted under 35 U.S.C. 154(b) by 0 days.

(21) Appl. No.: 17/109,816

(22) Filed: Dec. 2, 2020

(65) Prior Publication Data

US 2021/0254919 A1 Aug. 19, 2021

Related U.S. Application Data

(60) Provisional application No. 62/946,049, filed on Dec. 10, 2019, provisional application No. 62/961,428, filed on Jan. 15, 2020.

(51) Int. Cl.

| | |
|---|---|
| ***F42B 14/02*** | (2006.01) |
| ***F42B 14/06*** | (2006.01) |
| ***F42B 30/02*** | (2006.01) |
| ***F41A 21/18*** | (2006.01) |

(52) U.S. Cl.

CPC ..... *F42B 14/02* (2013.01); *F41A 21/18* (2013.01); *F42B 14/064* (2013.01); *F42B 30/02* (2013.01)

(58) Field of Classification Search

CPC ..... F41A 21/18; F42B 14/02; F42B 14/06; F42B 14/064; F42B 14/065; F42B 14/067

USPC ..... 42/78

See application file for complete search history.

(56) References Cited

U.S. PATENT DOCUMENTS

| | | | | | |
|---|---|---|---|---|---|
| 37,193 | A * | 12/1862 | Alsop | F41A 21/325 | 42/78 |
| 290,738 | A * | 12/1883 | Brown | F41A 21/12 | 42/76.01 |
| 1,659,625 | A * | 2/1928 | Cowan | F42B 5/02 | 42/78 |
| 2,345,089 | A * | 3/1944 | Born | F42B 14/02 | 42/78 |
| 2,917,809 | A * | 12/1959 | Braatz | B21C 37/153 | 42/78 |
| H1365 | H * | 11/1994 | Amspacker | F41A 21/12 | 42/76.02 |
| 9,939,223 | B1 * | 4/2018 | Heizer | F41A 19/10 | |

* cited by examiner

*Primary Examiner* — Bret Hayes

(74) *Attorney, Agent, or Firm* — Dowell & Dowell, P.C.

(57) ABSTRACT

A rifled barrel has a cylindrical channel longitudinally extending within the rifled barrel between an oppositely oriented muzzle opening and a breach opening, the cylindrical channel having a rifled portion and a non-rifled portion, the rifled portion having a land and a groove helically extending along a surface of the cylindrical channel from the muzzle opening toward the breach opening, the non-rifled portion being smooth and having a consistent diameter along a length. The diameter of the non-rifled portion of the cylindrical channel is equal to a diameter of the rifled portion measured between oppositely oriented sections of the groove. A transitional section of the rifled portion has a diameter measured between oppositely oriented land sections that gradually decreases along a section of the rifled portion adjacent to the non-rifled portion until equaling the diameter of the non-rifled portion.

10 Claims, 2 Drawing Sheets

RIFLED BARREL HAVING A RIFLED AND NON-RIFLED PORTION

FIELD OF THE INVENTION

The present invention is directed to a rifled barrel for firing ammunition projectiles, which includes a bullet and casing wherein the bullet and casing are of a type used with firearms, either breechloader or muzzleloader firearms. The barrel includes a rifled portion and a non-rifled portion, wherein the rifled portion extends longitudinally from a muzzle of the barrel toward the non-rifled portion. The non-rifled portion of the barrel extends longitudinally from an opposite end of the barrel located adjacent to a loading chamber or breech of the firearm toward the rifled portion, and together the rifled and non-rifled portions form a continuous cylindrical channel through the rifled barrel.

BRIEF DESCRIPTION OF THE RELATED ART

There are two general classes of firearm: muzzleloader firearms and breechloader firearms. Most modern firearms are breechloader firearms, or a firearm in which a shell or cartridge is inserted or loaded into a chamber integral to a rear portion of a barrel. In contrast, most early firearms where muzzleloaders, or firearms wherein a projectile and propellant are loaded from a muzzle of the firearm. Breechloaders are the more popular and technologically advanced class of firearms. However, muzzleloaders are still used today by hunters, competitive shooters, and firearm enthusiasts. Both classes of firearms have their own associated operational issues relative to the barrel that are made more prominent over the course of use.

A main concern with muzzleloaders is barrel and breech fouling. Fouling is a built-up layer of particulates, including dirt, propellant residue, and moisture, along inner surfaces of the firearm's components. A main source of fouling is the propellant used in muzzleloaders. Black powder or a similar synthetic substitute is deposited into the barrel of the firearm via the muzzle, free from a shell or cartridge found in projectiles for breechloaders. Unfortunately, both black powder and synthetic substitutes for black powder are corrosive and hygroscopic. When either are ignited at discharge of the muzzleloader, the resulting residue attracts moisture. If left to settle the mixture of water moisture and propellant residue will form a layer on inner surfaces that will pit, rust, and corrode such surfaces.

Unfortunately, such layers often develop oftentimes after only one or two shots fired from the muzzleloader. To combat fouling, muzzleloader barrels are often seasoned to create a protective layer that is at least resistant to fouling. Such season often involves cleaning and heating the barrel before applying a lubricant. Cleaning the barrel removes contaminants and fouling. Heating the barrel causes the metal to expand and open pores in the barrel surface. Applying the lubricant into the heated barrel allows more lubricant to permeate farther into the barrel surface to create a protective barrier.

Loading a muzzleloader firearm after cleaning and before firing a further shot can be a strenuous task, as the components of the projectile fit tightly into the barrel. After seasoning a muzzleloader barrel and then firing it several times, it can be extremely difficult to load the muzzleloader with typical components. Sabots are typically used with muzzleloaders to properly align a bullet within a barrel and to create a proper gas seal around the bullet upon discharge and ignition of the propellant. However, sabots seat the bullet in a muzzle-facing seat and add to the diameter of the projectile in the barrel. Using sabots is necessary with some bullets, but exacerbates the difficulty with loading the projectile into the barrel of the muzzleloader. To ensure accuracy of the muzzleloader, the projectile must catch barrel rifling to properly spin and ensure a proper trajectory out of the barrel. For bullets of small caliber than the barrel from which they are fired, sabots are necessary to achieve this accuracy.

As such, there is a need in the muzzleloader art for a rifled barrel that is both easily loadable, even after several discharges from the firearm, and which also maintains a high level of accuracy during each shot.

With both breechloader and muzzleloader firearms, there is also an issue of land wear along two ends of the rifled barrel. In known rifled barrels, the transition between rifled and non-rifled portions of a barrel are not gradual. In other words, when looking along a cross-sectional length of a rifled barrel, the surface of the lands of the rifling is squared adjacent to the non-rifled portion. The force created by ignition of a propellant causes a violent collision between the bullet and squared land as the bullet initially contacts the lands of the rifled barrel. The collision and heat of repeated firing of the firearm wears the lands down predominantly at the ends of the rifled barrel, both at the breech and muzzle ends. Rifling land wear leads to reduced accuracy of projectiles fired from any rifled barrel, whether attached to a breechloader or a muzzleloader firearm. For automatic breechloader firearms that fire multiple projectiles in rapid succession, this issue is exacerbated.

It would be advantageous for a rifled barrel to include a transitional portion between a non-rifled portion and a rifled portion to further enhance accuracy of projectiles. Such a rifled barrel could also be advantageous with certain types of ammunition that are adapted to increase in diameter and circumference after being loaded into the rifled barrel. Such a rifled barrel would be advantageous for increasing accuracy in both breechloader and muzzleloader firearms.

SUMMARY OF THE INVENTION

It is a primary objective of this disclosure to teach a preferred embodiment of a rifled barrel having a cylindrical channel longitudinally extending within the rifled barrel between an oppositely oriented muzzle opening and a breach opening, the cylindrical channel having a rifled portion and a non-rifled portion, the rifled portion having a land and a groove helically extending along a surface of the cylindrical channel from the muzzle opening toward the breach opening, the non-rifled portion being smooth and having a consistent diameter along a length, wherein the diameter of the non-rifled portion of the cylindrical channel is equal to a diameter of the rifled portion measured between oppositely oriented sections of the groove, and wherein a diameter measured between oppositely oriented land sections of the rifled portion along a partial length adjacent to the non-rifled portion gradually increases until equaling the diameter of the non-rifled portion.

A further objective is to teach an embodiment of the rifled barrel wherein the length of the non-rifled portion is configured to accommodate a cylindrical body of a projectile.

Another objective is to teach an embodiment of the rifled barrel wherein the non-rifled portion of the cylindrical channel is insertably removable from the barrel through the breach opening.

A further objective is to teach an embodiment of a muzzleloader firearm having the preferred rifle barrel embodiment, or one of the alternative embodiments described herein.

Yet another objective of this disclosure is to teach a method of converting a fully rifled barrel to a partially rifled barrel, including grinding down lands located along an inner surface of the rifled barrel along a partial length of the barrel such that the lands are fully removed along the partial length to form a non-rifled portion, partially grinding down lands along the inner surface of the rifled barrel along a partial length of barrel adjacent to the non-rifled portion such that a diameter between oppositely oriented lands gradually decreases along the partial length toward a muzzle of the partially rifled barrel, and maintaining a consistent diameter throughout the length of the partially rifled barrel measured between oppositely oriented sides of the non-rifled portion and between oppositely oriented grooves of a rifled section of the partially rifled barrel.

BRIEF DESCRIPTION OF THE DRAWINGS

A better understanding of the invention will be had with respect to the accompanying drawings wherein.

DESCRIPTION OF THE PREFERRED EMBODIMENT

It will be appreciated that numerous specific details have been provided for a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered so that it may limit the scope of the embodiments described herein in any way, but rather as merely describing the implementation of the various embodiments described herein.

The description that follows, and the embodiments described therein, are provided by way of illustration of an example, or examples, of particular embodiments of the principles of the present invention. These examples are provided for the purposes of explanation, and not limitation, of those principles and of the invention. It will also be appreciated that similar structures between embodiments are marked with identical reference numbers for ease of reference.

The rifled barrel embodiments described herein are generally discussed relative to use with a muzzleloader firearm. However, the same rifled barrel embodiments may be used with breechloader firearms (i.e. non-muzzleloader firearms). Further, the firearms, either muzzleloaders or non-muzzleloaders, are not limited to rifles and handguns. The rifled barrel embodiments described herein may be used with any applicable firearm, including, but not limited to, handguns, long guns, rifles, shotguns, carbines, machine guns, submachine guns, automatic rifles, assault rifles, personal defense weapons, battle rifles, etc. The rifled barrel may also be used with any applicable ammunition, including sabots, bullets, rounds, etc.

Figure 1:
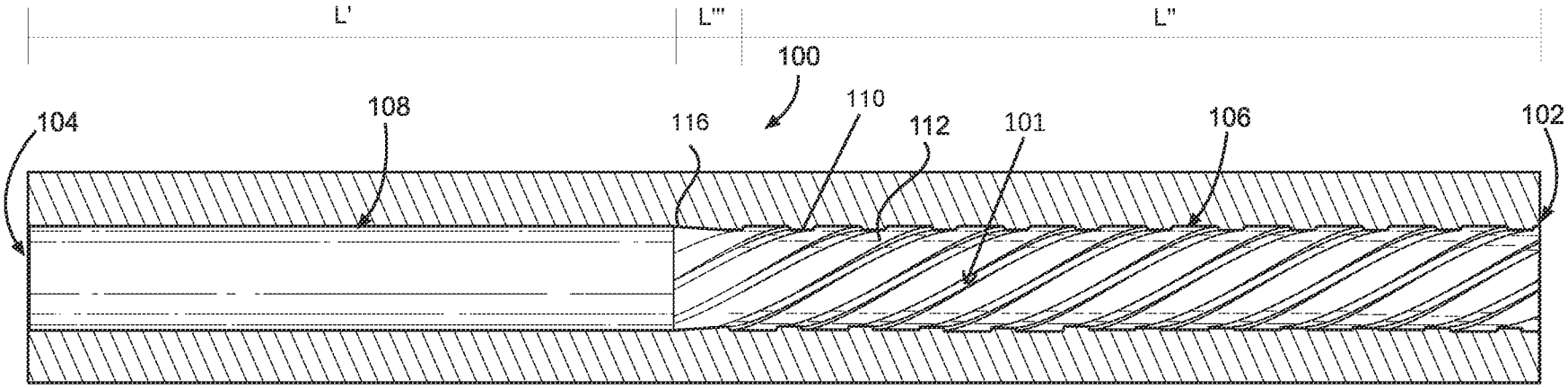
FIG. 1 is a cross-sectional view of a rifled barrel according to an embodiment of the present invention.

FIG. 1 provides a cross-sectional view of a preferred embodiment of a rifled barrel 100. Such a rifled barrel 100 may be assembled, along with other typical constituent parts, to form either a muzzleloader or a breechloader firearm. The rifled barrel 100 has two oppositely oriented ends, namely a muzzle end 102 and a breech end 104. The muzzle end 102 includes an opening from which a projectile, typically a bullet, exits upon discharge of the firearm. The breech end 104 is attached to the firearm such that a round or other fireable unit, including a case or cartridge, primer, projectile, and propellant, is loadable into the rifled barrel 100 and configured to sit within a non-rifled portion 108 of the barrel near the breach end before ignition of the propellant. Connection of the rifled barrel 100 to the firearm occurs in a manner known to those skilled in the art, whether the firearm be a muzzleloader or a breechloader.

A cylindrical channel 101 extends longitudinally through, preferably, a center of the rifled barrel 100. The cylindrical channel 101 is preferably coaxial with the rifled barrel 100, but may arranged in such a manner that it is not coaxial. The cylindrical channel 101 includes a rifled portion 106 and the non-rifled portion 108. The rifled portion 106 of the cylindrical channel 101 includes rifling in the form of lands 110 and grooves 112 extending helically, or in a spiraled pattern, along a surface of the cylindrical channel. The rifling, or lands 110 and grooves 112 together, of the rifled portion 106 extends from the muzzle end 102 towards the breech end 104 and ends adjacent to the non-rifled portion 108. The non-rifled portion 108 extends from the breech end 104 towards the muzzle end 102 along a partial length of the cylindrical channel 101 and meets with the rifled portion 106 along the length of the cylindrical channel between the breech end 104 and muzzle end 102. The non-rifled portion 108 does not have any lands 110, and therefore does not have corresponding grooves 112. The length of either the rifled portion 106 or the non-rifled portion 108 may vary between embodiments of the rifled barrel 100. Generally, however, the length of the rifled portion 106 will be greater than the length of the non-rifled portion 108 for reasons discussed further herein.

Lengths L', L", and L"' are provided to provide directional reference when discussing a longitudinal direction or discussing lengths of the various structures within the rifled barrel 100. Specifically, length L' denotes a length of the non-rifled portion 108, length L" denotes a length of the rifled portion 106 with consistent or uniform land 110 heights, or diameter D" between opposing lands 110, and length L"' denotes a length of a transitional section 116 of the rifled portion 106 with sloping lands having changing land height and diameter D". The specific values of lengths L', L", and L"' may vary individually, and in relation to each other, as desired to achieve desired performance across varying parameters. An overall length of the cylindrical body 101 is a summation of lengths L', L", and L"'. A length of the rifled portion 106 is a summation of lengths L" and L"'.

Figure 2:
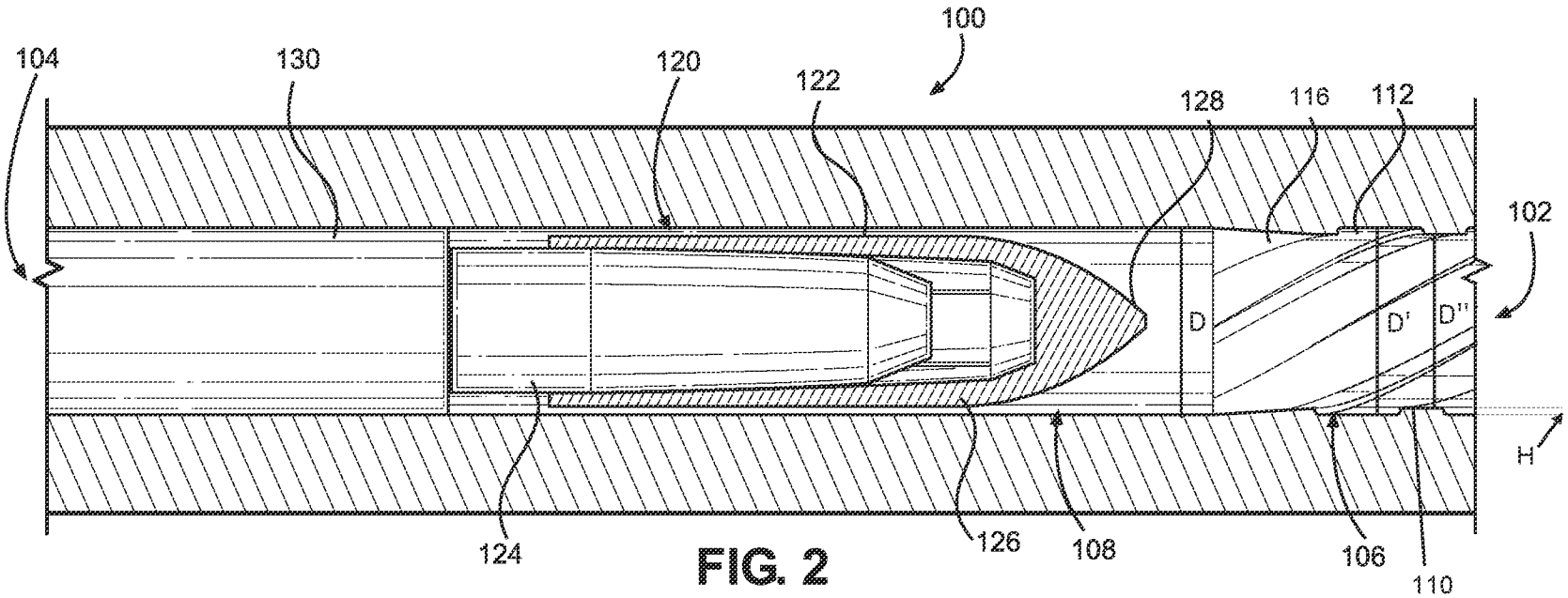
FIG. 2 is a cross-sectional view of a rifled barrel embodiment configured to be used with a muzzleloader firearm, wherein an improved projectile, having a casing positioned over a front end of a bullet and along a partial length of the bullet, is loaded into a non-rifled portion of the barrel.

FIG. 2 shows a representative projectile 120 loaded into the non-rifled portion 108 of the cylindrical channel 101. In this embodiment, the rifled barrel 100 is part of a muzzleloader firearm and the projectile 120 includes a bullet 124 with a casing 122 positioned over a forward end of the bullet. A forward end 128 of the casing 122 is directed toward the muzzle end 102 of the rifled barrel 100. A length of a cylindrical body 126 of the casing is positioned wholly along the non-rifled portion 108 upon the projectile 120 being loaded, but before discharge. Propellant 130 is positioned behind the projectile 120, as typical in muzzleloader firearms.

While methods of loading the projectile 120 into the rifled barrel 100 will vary between embodiments depending on the type of firearm the rifled barrel is a part of, certain structures and corresponding functions are common across all embodiments.

As shown in FIG. 1, and more clearly in FIG. 2, the rifled portion 106 includes the transitional section 116, or a length L''' of sloped lands 110, along a partial length of the rifled portion adjacent to the non-rifled portion 108. Moving from the muzzle end 102 toward the breech end 104, the sloped lands 116 gradually decrease from a standard or uniform height of the lands 110 down to a height of zero or to match a groove height.

The standard height is the height H of the lands 110 above the grooves 112 in the remaining, non-sloped length L'' of the rifled portion 106. The standard height is consistent within the same rifled barrel 100, but may vary between other rifled barrels. Further, the standard height of the grooves 110 is considered in an ideal barrel 100 that does not include wear or fouling. In other words, along the transitional section 116, a diameter D'' between the lands 110 increases gradually moving along the transitional section 116 from the muzzle end 102 towards the breech end 104 until reaching the non-rifled portion 108, at which point the diameter D'' between the lands equals a diameter D' between the grooves 112. Diameter D' is the diameter between grooves 112. Diameters D'' and D' between lands 110 and grooves 112 are measured between oppositely oriented sides of the cylindrical cavity, or at 180 degrees when viewed along a transverse cross-section. The slope of the transitional section 116, or rate of change between D'' and D' along the transitional section, may be continuous or non-continuous. In other words, the slope of the transitional section 110 may be straight or curved.

A diameter D of the non-rifled portion 108 is preferably equal to the diameter D' between the grooves 112 of the rifled portion 106. This is important, along with the partial length L''' of the rifled portion 106 with sloped lands 110 adjacent to the non-rifled portion 108, to the function of all embodiments of the rifled barrel 100. When propellant is ignited, or upon being loaded into the rifled barrel 100, forces act upon the bullet 124 to force it into the casing 122. Whether the bullet 124 is forced downward or backward into the casing 122, as with a bullet and sabot combination, or the casing is forced downward or backward over the bullet, as shown in FIG. 2, is not critical to the function or structure of the rifled barrel 100. The critical factor is that this causes the casing 122, or projectile 120 in general, to expand circumferentially towards a surface of the non-rifled portion along a length of the cylindrical body 126 of the casing 122. The projectile 120 therefore expands to fill the lateral space of the non-rifled portion enough to meet the surface, but not so tightly as to unduly restrict forward movement of the projectile out of the rifled barrel 100. As the projectile 120 is forced forward toward the muzzle end 102 and into contact with the lands 110 of the rifled portion 106, the casing 122 has expanded laterally to fill the diameter of the non-rifled portion. The sloped portion of the lands 110 allow the casing 122 to gradually form around the lands as the projectile 120 moves forward, or allows the lands to bite into the casing gradually, without an edge that would otherwise shear or destroy the casing while traveling through the barrel. The projectile 120 and/or barrel would be damaged without the sloped portion of the lands 110.

Such expansion of the projectile 120 to the full diameter of the non-rifled portion 108, as opposed to expansion around lands 110 in a fully rifled barrel, allows for a greater bite, or formation of the projectile around the lands, while the projectile travels through and out of the rifled barrel 100. This in turn promotes greater accuracy of the projectile 120 upon leaving the rifled barrel 100 and travelling towards its intended target.

While a particular projectile 120 is shown in the FIGS. 1-4, other known types of projectiles are conceived to operate with the rifled barrel 100. Such known types of projectiles include sabots used with bullets and other similar projectiles with expandable elements. Sabots include an open cup or holder that is partially open to accept and secure a bullet in the barrel, with the oriented toward the muzzle of the barrel and the sabot behind the bullet towards the breech. The projectile 120 shown in is loadable into the rifled barrel 100 easily in either a compound form, wherein the bullet 124 and casing 122 are already connected, or in a separate form, wherein the bullet 124 is inserted first and separately from the casing followed by the insertion of the casing.

Traditional breechloader rounds and bullets are also compatible with the rifled barrel embodiments described herein. In a breechloader firearm, the transitional section 116 does provide less wear on the rifled barrel 100 overall and provide increased performance to the bullet, as less force is wasted on the initial contact between the lands 110 and 116 and bullet and is instead transferred more efficiently into spinning the bullet along the lands 110 of the rifling.

Figure 3:
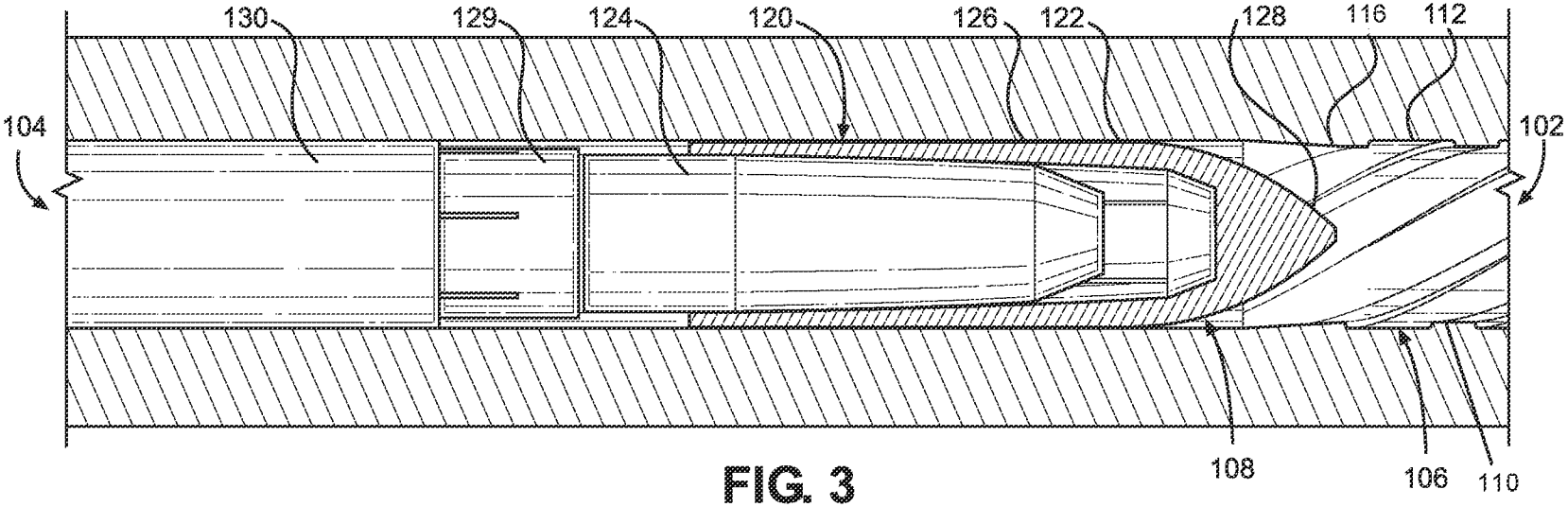
FIG. 3 is a cross-sectional view of the rifled barrel embodiment of FIG. 2, wherein an alternative embodiment of the improved projectile shown in FIG. 2 having a tail guide is loaded into the barrel.

FIG. 3 shows an alternative embodiment of the rifled barrel of shown in FIG. 2, where the projectile 120 has a tail guide portion 129 inserted into the rifled barrel 100 before insertion of the bullet 124 and casing 122. As shown in FIG. 3, the inclusion of the tail guide portion 129 extends the forward end 128 of the casing 122 into the rifled portion 106 of the cylindrical channel 101. This is permissible in all rifled barrel embodiments, as the forward end 128 does not contact the lands 110 during travel through the rifled portion 106. The length of the cylindrical body 126 of the projectile 120 must be positioned fully within the non-rifled portion before ignition of the propellant to ensure even expansion of the projectile 120 before contact with the rifling. As suggested earlier, the lengths L', L'', and L''' of the rifled portion 106 and non-rifled portion 108 are variable. It is preferable for the rifled portion 106 to be as long as possible relative to a total given length of a rifled barrel 100, as a longer length of rifling promotes greater accuracy through more rotational force imparted on the bullet. The non-rifled portion 108 should be long enough to allow the entire length of the cylindrical body of the projectile 120 to fully expand within the non-rifled portion. As shown in FIG. 3, that may not necessarily mean that the length L' of the non-rifled portion 108 is greater than or equal to the length of the projectile 100. Indeed, the length L' of the non-rifled portion may be shorter than the projectile 120 in certain circumstances.

Again, a cartridge or round typically compatible with a breechloader firearm may be interchangeable with the projectile 120 in the rifled barrel embodiment of FIG. 3. A partial length of a bullet of such a round could likewise extend into the rifled portion 106 of the barrel 100 after the round is loaded, but before firing.

Figure 4:
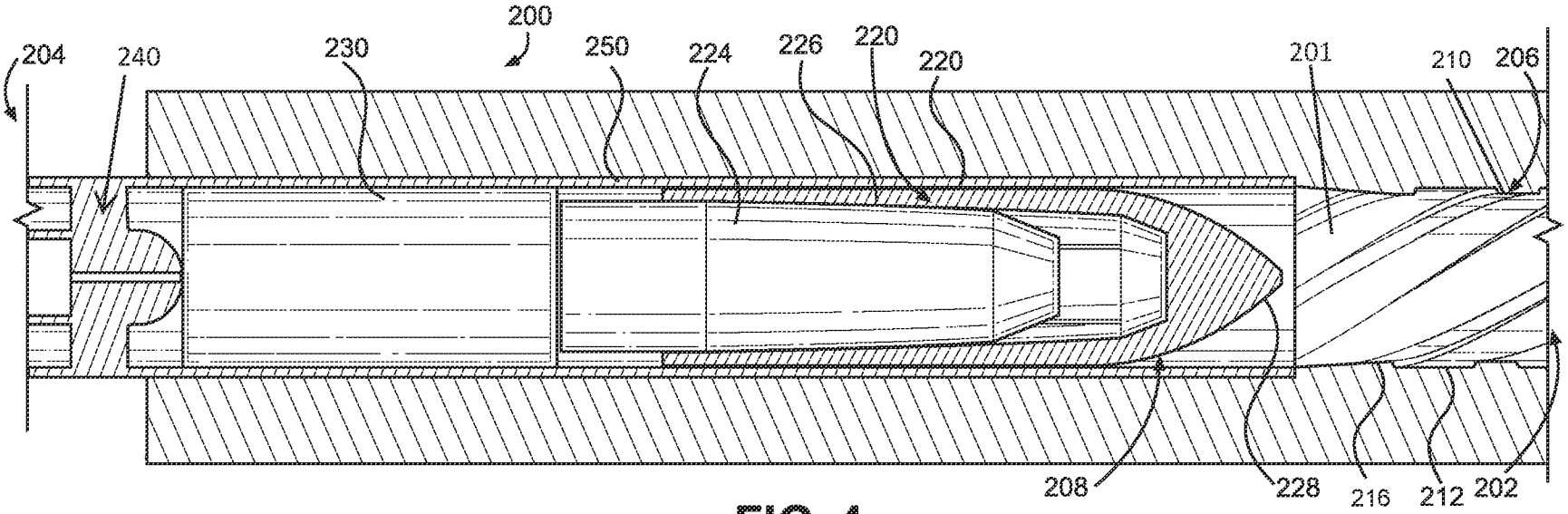
FIG. 4 is a cross-sectional view of an alternative rifled barrel embodiment having an insertable non-rifled portion.

The rifled barrel 200 embodiment shown in FIG. 4 includes all elements of the previous rifle barrel 100 embodiment provided in FIGS. 1-3. The rifled barrel 200 includes a cylindrical channel 201 having a rifled portion 206 and a non-rifled portion 208. The rifled portion 206 includes lands 210 and grooves 212 in a helical pattern along an inner surface of the cylindrical channel along the length of the rifled portion. Further, the rifled portion 206 includes a transitional section, or sloped lands, 216 along a partial length of the rifled portion adjacent to the non-rifled portion.

In this rifled barrel embodiment 200, the non-rifled portion is formed along an inner surface of a slidably insertable tube 250. The slidably insertable tube 250 is insertable through the breach end 204 of the rifled barrel 200. The insertable tube forming the non-rifled portion 208 may be preferable to avoid directly grinding or cutting down the lands 210 of a rifled barrel 200 to form a non-rifled portion.

This particular configuration is preferable in use with in-line muzzleloader firearms, wherein the rifled barrel 200 is removable from the in-line muzzleloader and the non-rifled portion 208 is accessible via the breech end 204 after removal of a breech plug 240 for cleaning.

The rifled barrel embodiments described herein may be used with either breechloader firearms (i.e. non-muzzleloader firearms) or muzzleloader firearms. Further, the firearms, either muzzleloaders or non-muzzleloaders, are not limited to rifles and handguns. The rifled barrel embodiments described herein may be used with any applicable firearm, including, but not limited to, handguns, long guns, rifles, shotguns, carbines, machine guns, submachine guns, automatic rifles, assault rifles, personal defense weapons, battle rifles, etc.

The rifled barrel embodiments described herein may be formed as a separable, discrete part of a firearm, or may be formed with one or more other constituent parts typically found in firearms. One skilled in the art would appreciate other parts of a firearm, either muzzleloader or breechloader, not shown and described can be combined with the rifled barrel embodiments shown and described to form a complete firearm. The invention provided herein relates particularly to the structure of the rifled barrel, and therefore other parts necessary to form a complete firearm are omitted for ease of reference.

I claim:

1. A rifled barrel, comprising:

a cylindrical channel longitudinally extending within the rifled barrel between an oppositely oriented muzzle opening and a breach opening, the cylindrical channel having a rifled portion and a non-rifled portion, the rifled portion having a land and a groove helically extending along a surface of the cylindrical channel from the muzzle opening toward the breach opening, the non-rifled portion being smooth and having a consistent diameter along an entire length of the non-rifled portion, wherein the diameter of the non-rifled portion of the cylindrical channel is equal to a diameter of the rifled portion measured between oppositely oriented sections of the groove along an entire length of the rifled portion, and wherein a diameter measured between oppositely oriented land sections of the rifled portion along a partial length of the rifled portion adjacent to the non-rifled portion gradually increases until equaling the diameter of the non-rifled portion.

2. The rifled barrel of claim 1, wherein the length of the non-rifled portion is configured to accommodate a cylindrical body of a projectile.

3. The rifled barrel of claim 1, wherein the non-rifled portion of the cylindrical channel is insertably removable from the barrel through the breach opening.

4. A muzzleloader firearm comprising at least the rifled barrel according to claim 1.

5. A breechloader firearm comprising at least the rifled barrel according to claim 1.

6. A method of converting a fully rifled barrel to a partially rifled barrel, comprising:

reducing lands located along an inner surface of the rifled barrel along a partial length of the barrel such that the lands are fully removed along the partial length to form a non-rifled portion, partially reducing lands along the inner surface of the rifled barrel along a partial length of barrel adjacent to the non-rifled portion such that a diameter between oppositely oriented lands gradually decreases along the partial length toward a muzzle end of the partially rifled barrel, and maintaining a consistent diameter throughout the length of the partially rifled barrel measured between oppositely oriented sides of the non-rifled portion and between oppositely oriented grooves of a rifled section of the partially rifled barrel.

7. A rifled barrel, comprising:

a rifled portion extending longitudinally along the rifled barrel, and having helical lands and helical grooves extending longitudinally along a cylindrical surface of the rifled portion, a non-rifled portion extending longitudinally along the rifled barrel, and having a smooth cylindrical surface, the smooth cylindrical surface having a consistent diameter along an entire length of the non-rifled portion, and a transitional portion of the rifled portion extending longitudinally along the rifled barrel adjacent to the non-rifled portion and having sloped helical lands and transitional helical grooves, wherein the consistent diameter along the entire length of the non-rifled portion is equal to a diameter of the rifled portion measured between oppositely oriented helical grooves, and the diameter of the rifled portion measured between the oppositely oriented helical grooves is consistent along an entire length of the rifled portion.

8. The rifled barrel of claim 7, wherein a diameter of the transitional portion measured between oppositely oriented sloped helical lands increases along a length of the transitional portion toward the non-rifled portion.

9. The rifled barrel of claim 7, wherein the entire length of the non-rifled portion is configured to accommodate a body of a projectile.

10. The rifled barrel of claim 7, wherein the non-rifled portion is insertably removable from the rifled barrel.

* * * * *